US010364133B1

(12) United States Patent
Chen et al.

(10) Patent No.: US 10,364,133 B1
(45) Date of Patent: Jul. 30, 2019

(54) WHEELED CABINET MOUNTED CRANE

(71) Applicants: Kung-Cheng Chen, Taichung (TW); Lung-Chuan Huang, Taichung (TW)

(72) Inventors: Kung-Cheng Chen, Taichung (TW); Lung-Chuan Huang, Taichung (TW)

(73) Assignee: E-MAKE CO., LTD, Taichung (TW)

( * ) Notice: Subject to any disclaimer, the term of this patent is extended or adjusted under 35 U.S.C. 154(b) by 30 days.

(21) Appl. No.: 15/900,182

(22) Filed: Feb. 20, 2018

(51) Int. Cl.

| | |
|---|---|
| ***B66C 23/48*** | (2006.01) |
| ***B66C 23/70*** | (2006.01) |
| ***B66C 23/42*** | (2006.01) |
| ***B66C 23/46*** | (2006.01) |
| ***B66C 23/78*** | (2006.01) |

(52) U.S. Cl.
CPC ..... *B66C 23/48* (2013.01); *B66C 23/42* (2013.01); *B66C 23/46* (2013.01); *B66C 23/701* (2013.01); *B66C 23/78* (2013.01); *B66C 2700/0378* (2013.01)

(58) Field of Classification Search
CPC ..... B66C 23/48; B66C 23/42; B66C 23/46; B66C 23/701; B66C 23/78; B66C 2700/0378
See application file for complete search history.

(56) References Cited

U.S. PATENT DOCUMENTS

| | | | | |
|---|---|---|---|---|
| 4,412,775 | A * | 11/1983 | Molitor | B66C 1/0212 414/626 |
| 6,286,695 | B1 * | 9/2001 | Tetreault | B66C 23/48 212/203 |
| 7,210,590 | B2 * | 5/2007 | Labrecque | A22B 7/006 212/180 |
| 8,646,628 | B2 * | 2/2014 | Martin | B66C 23/76 212/197 |
| 9,556,898 | B2 * | 1/2017 | Gentry | F16B 7/10 |
| 10,274,006 | B2 * | 4/2019 | Gentry | F16B 7/10 |
| 2001/0006596 | A1 * | 7/2001 | Vickary | B66C 1/42 414/543 |
| 2018/0072545 | A1 * | 3/2018 | Jones | B66F 9/0655 |
| 2018/0201485 | A1 * | 7/2018 | Liu | B66C 1/447 |
| 2018/0284717 | A1 * | 10/2018 | MacArthur | B66F 9/061 |

* cited by examiner

*Primary Examiner* — Kaitlin S Joerger

(57) ABSTRACT

A cabinet includes a crane including an attachment board secured to the cabinet; a receptacle on the attachment board and including threaded holes; a hollow member on the attachment board; an outrigger on bottom of the attachment board and including a slot, a rear sliding tube, a caster mounted to a bottom of a rear end of the sliding tube, and a rod releasably secured to the sliding tube and in the slot; a boom having one end pivotably secured to the hollow member and including threaded holes, an extension extending from the other end and threadedly secured to the boom, a chain at an end of the extension, and two guard members a front portion of the boom; and an adjustable boom hoist having one end releasably secured to the threaded hole of the boom and the other end releasably secured to the threaded hole of the receptacle.

9 Claims, 12 Drawing Sheets

WHEELED CABINET MOUNTED CRANE

BACKGROUND OF THE INVENTION

1. Field of the Invention

The invention relates to cabinets and more particularly to a cabinet having a mounted crane.

2. Description of Related Art

It is always a difficult job for a worker to operate a crane to fasten and load a mechanical device for repairing automobiles in a garage. This is because the conventional crane is relatively large. Conventionally, there is a type of pneumatic crane available. However, its movement in the crowded garage is hindered by associated devices such as air compressor and lines. Further, there is no disclosure of mounting a crane onto a wheeled cabinet as far as the present inventor is aware. Thus, the need for improvement still exists.

SUMMARY OF THE INVENTION

It is therefore one object of the invention to provide a wheeled cabinet comprising a crane, the crane comprising a rectangular attachment board secured to one side of the cabinet; a receptacle disposed on a rear end of the attachment board and including a plurality of threaded holes disposed vertically on an surface; a hollow member disposed on a front top corner of the attachment board; an outrigger disposed on a bottom of the attachment board and including a slot, a sliding tube slidably projecting out of a rear end, a caster mounted to a bottom of a rear end of the sliding tube, and a rod releasably secured to the sliding tube and configured to slide along the slot; a boom having one end pivotably secured to the hollow member and including a plurality of threaded holes on a rear portion, an extension extending from the other end and threadedly secured to the boom, a chain disposed at an end of the extension, and at least one guard member disposed on a front portion of the boom for allowing the extension to frictionally pass through gaps between the at least one guard member and the boom; and an adjustable boom hoist having one end releasably secured to one of the threaded holes of the boom and the other end releasably secured to one of the threaded holes of the receptacle, the adjustable boom hoist including a support tube and a sliding tube member slidably disposed in the support tube.

The above and other objects, features and advantages of the invention will become apparent from the following detailed description taken with the accompanying drawings.

DETAILED DESCRIPTION OF THE INVENTION

Figure 1:
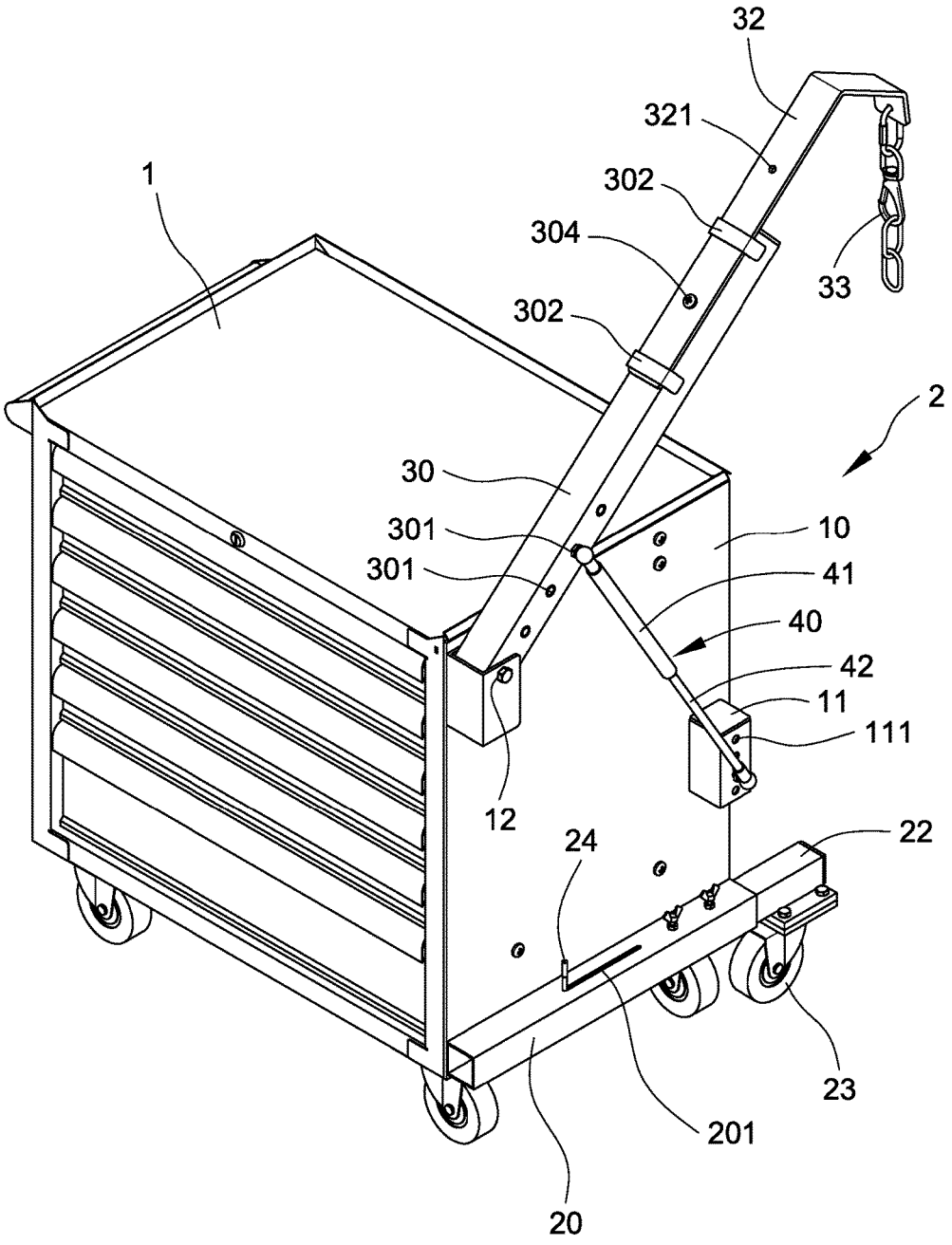
FIG. 1 is a perspective view of a wheeled cabinet having a mounted crane according to a first preferred embodiment of the invention.
Figure 2:
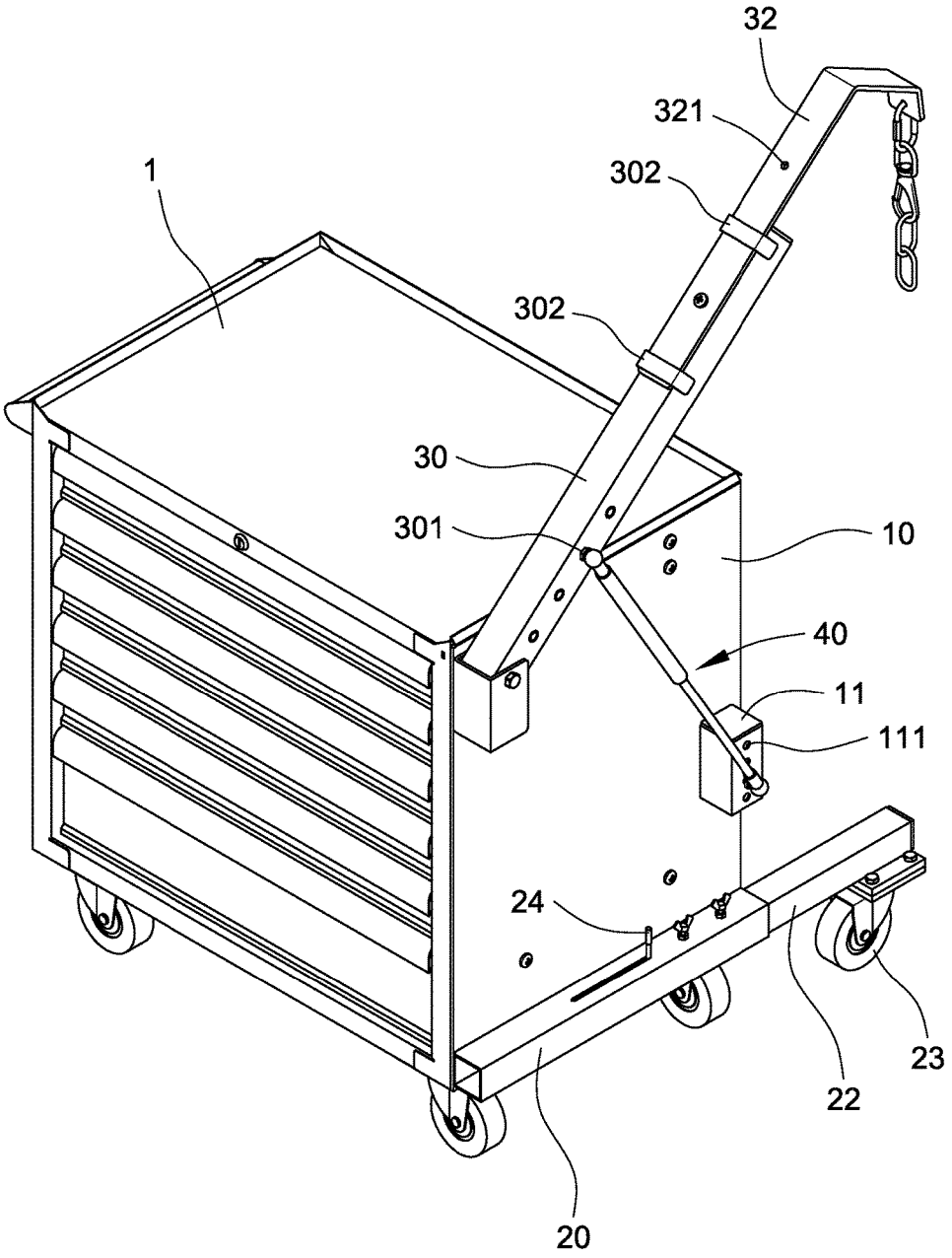
FIG. 2 is a view similar to FIG. 1 with the sliding tube fully extended.
Figure 3:
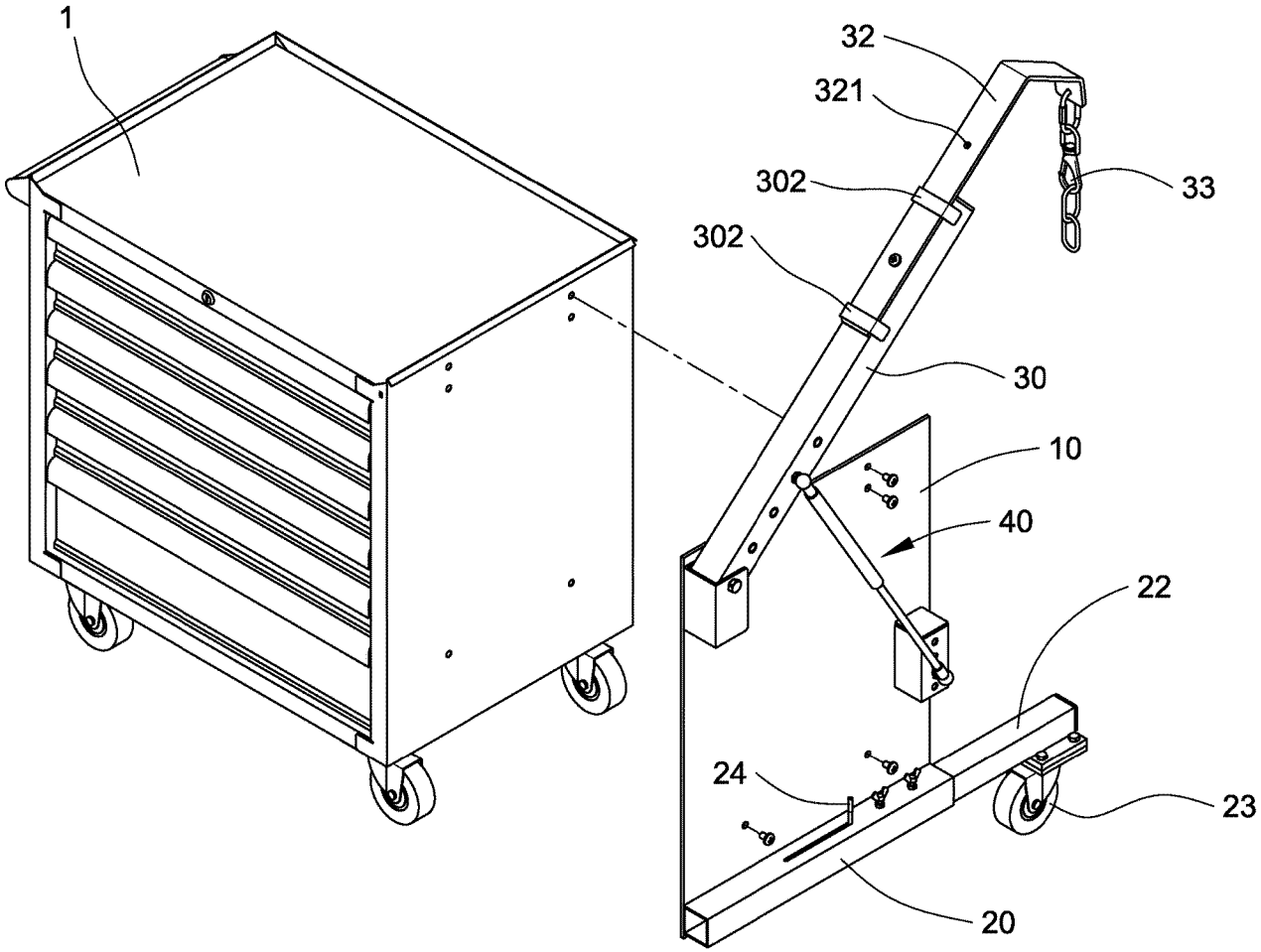
FIG. 3 is an exploded perspective view of FIG. 2.
Figure 4:
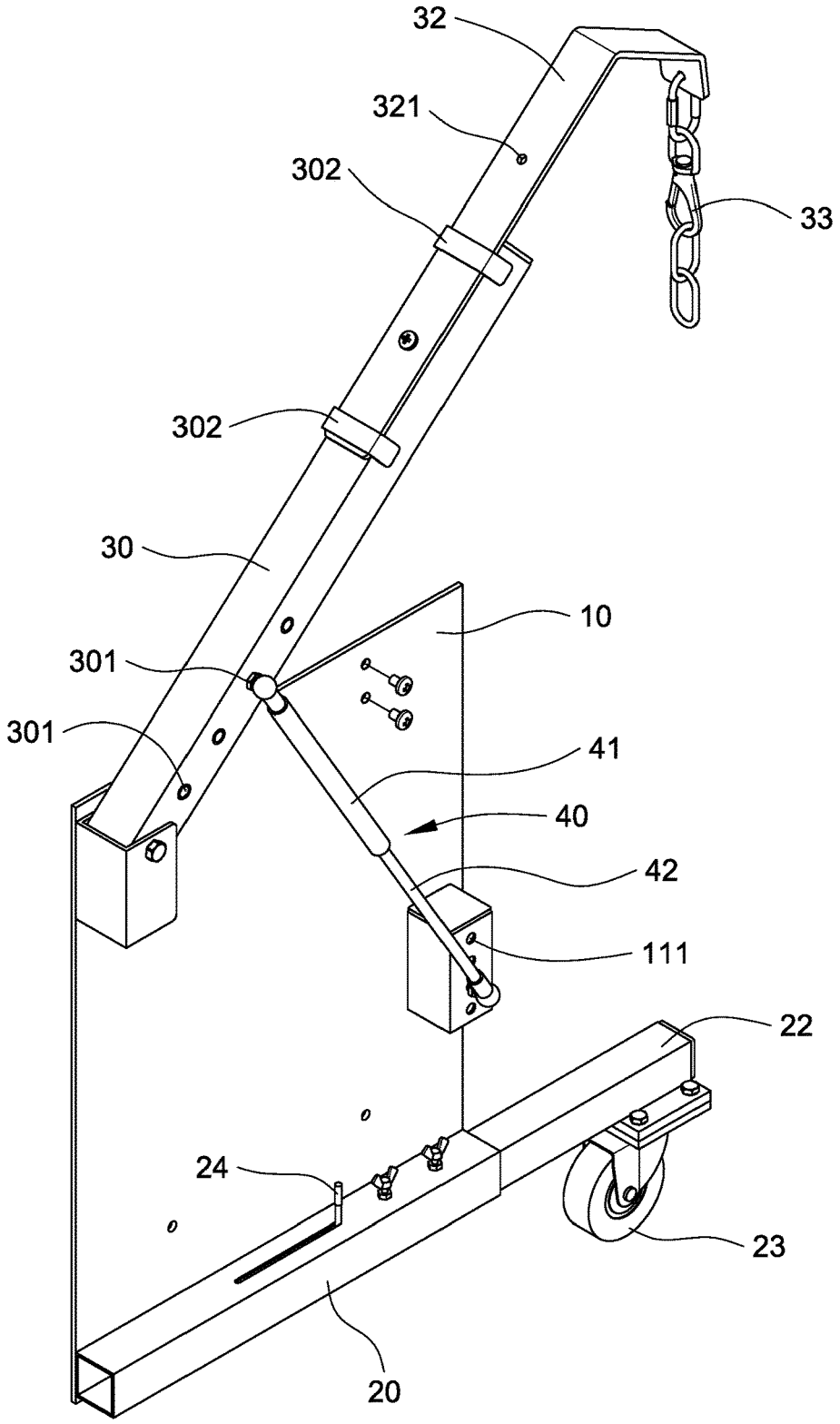
FIG. 4 is a perspective view of the crane of FIG. 3.
Figure 5:
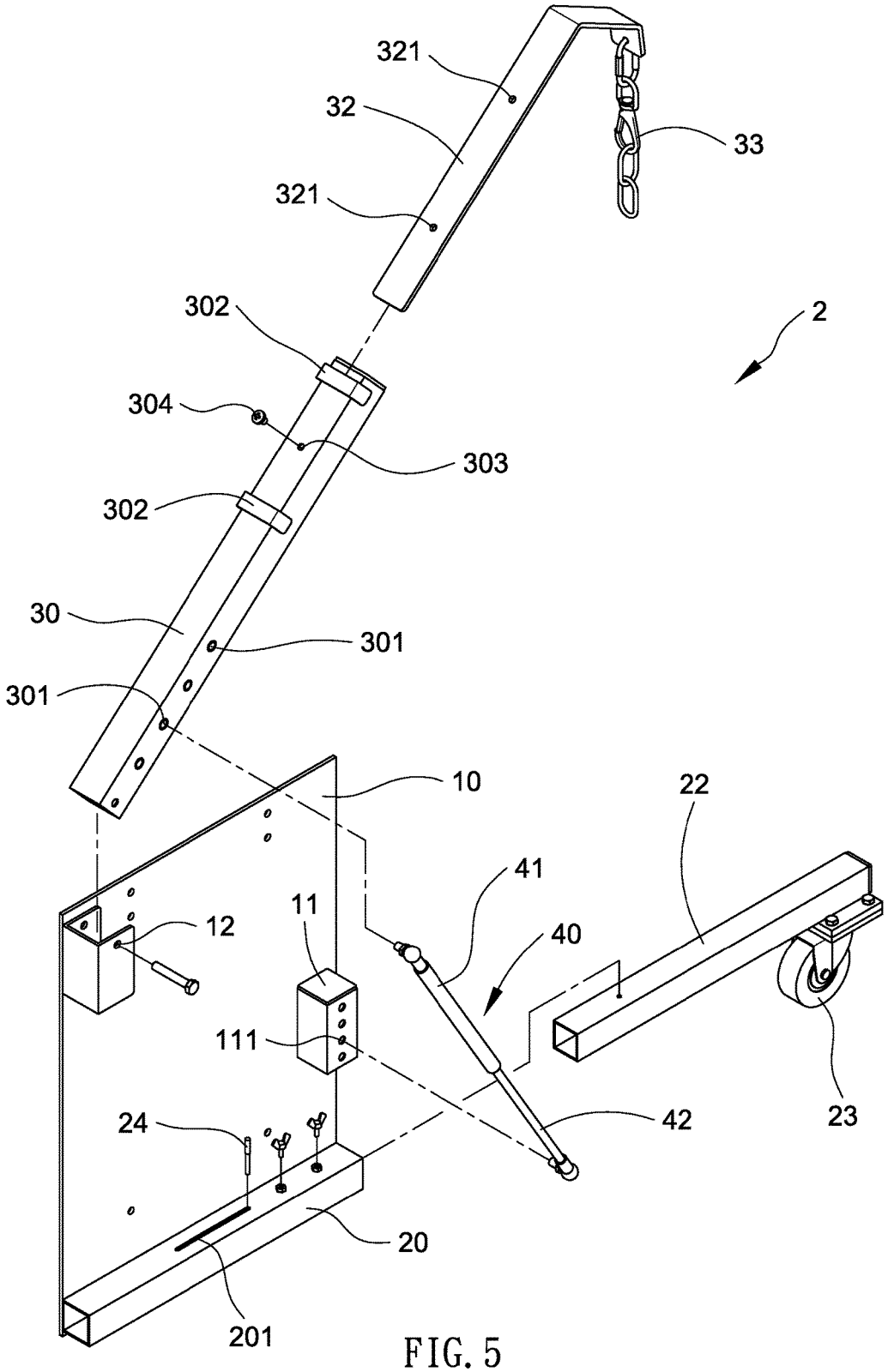
FIG. 5 is an exploded view of the crane.
Figure 6:
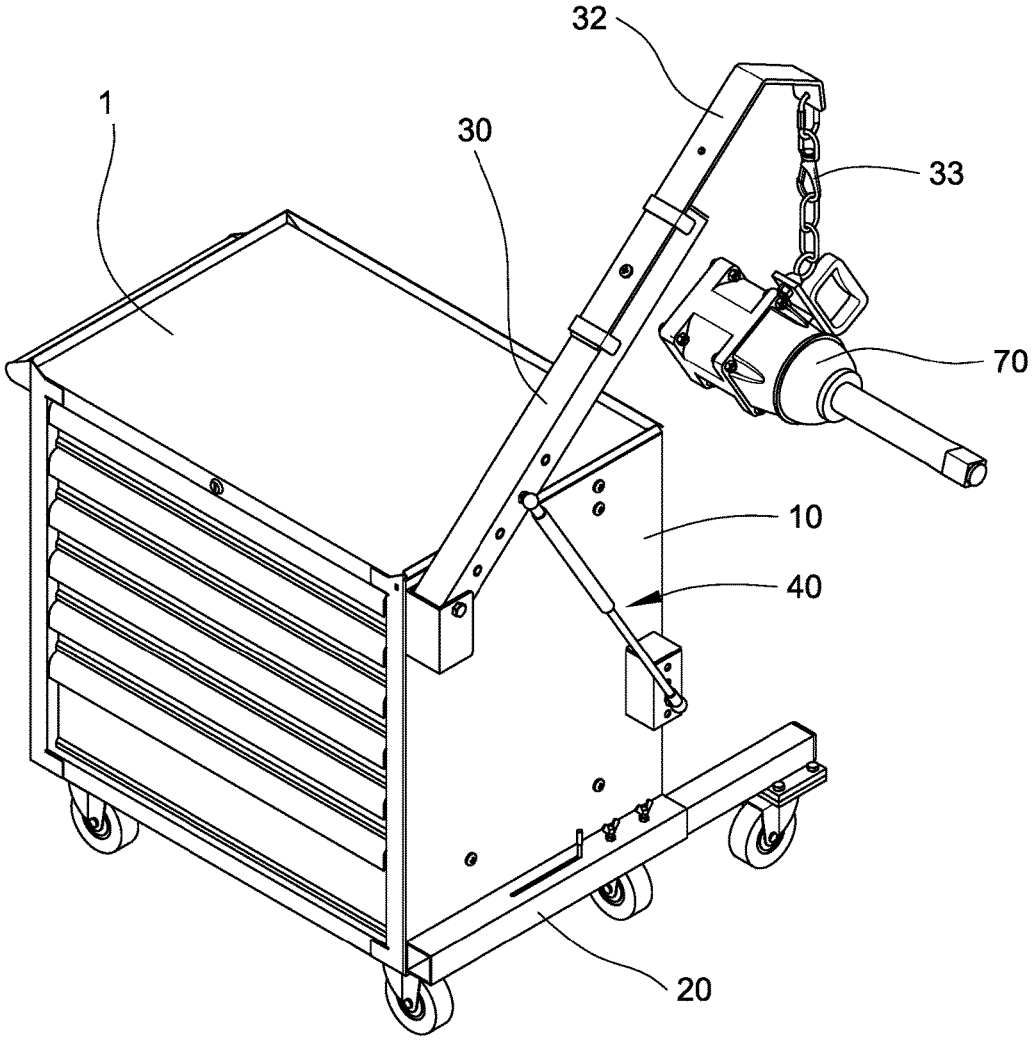
FIG. 6 is a view similar to FIG. 2 showing a mechanical device fastened and loaded by the chain.

Referring to FIGS. 1 to 8, a wheeled cabinet 1 according to a first preferred embodiment of the invention is shown. A crane 2 as the subject of the invention is discussed in detail below. The crane 2 comprises an attachment board 10, an outrigger 20, a boom 30 and an adjustable boom hoist 40.

The rectangular attachment board 10 is secured to one side of the cabinet 1. A receptacle 11 is provided on an intermediate portion of a rear end of the attachment board 10. A plurality of (e.g., four) threaded holes 111 are provided vertically on one surface of the receptacle 11 parallel to the attachment board 10. A hollow member 12 is provided on a front top corner of the attachment board 10. One end of the boom 30 is pivotably secured to the hollow member 12. The outrigger 20 is provided on a bottom of the attachment board 10 as a counterweight for increasing gravity of both the cabinet 1 and the crane 2 in operation. The outrigger 20 includes a sliding tube 22 slidably projecting out of a rear end, a caster 23 mounted to a bottom of a rear end of the sliding tube 22, and a rod 24 releasably secured to a top of a front portion of the sliding tube 22 and configured to slide along an elongated slot 201 on a top surface of the outrigger 20. The sliding tube 22 may be extended rearward by moving the rod 24 from a front end of the elongated slot 201 to a rear end thereof in order to increase a distance between the caster 23 and the rear end of the cabinet 1 so that stability of both the cabinet 1 and the crane 2 in operation can be increased.

Figure 7:
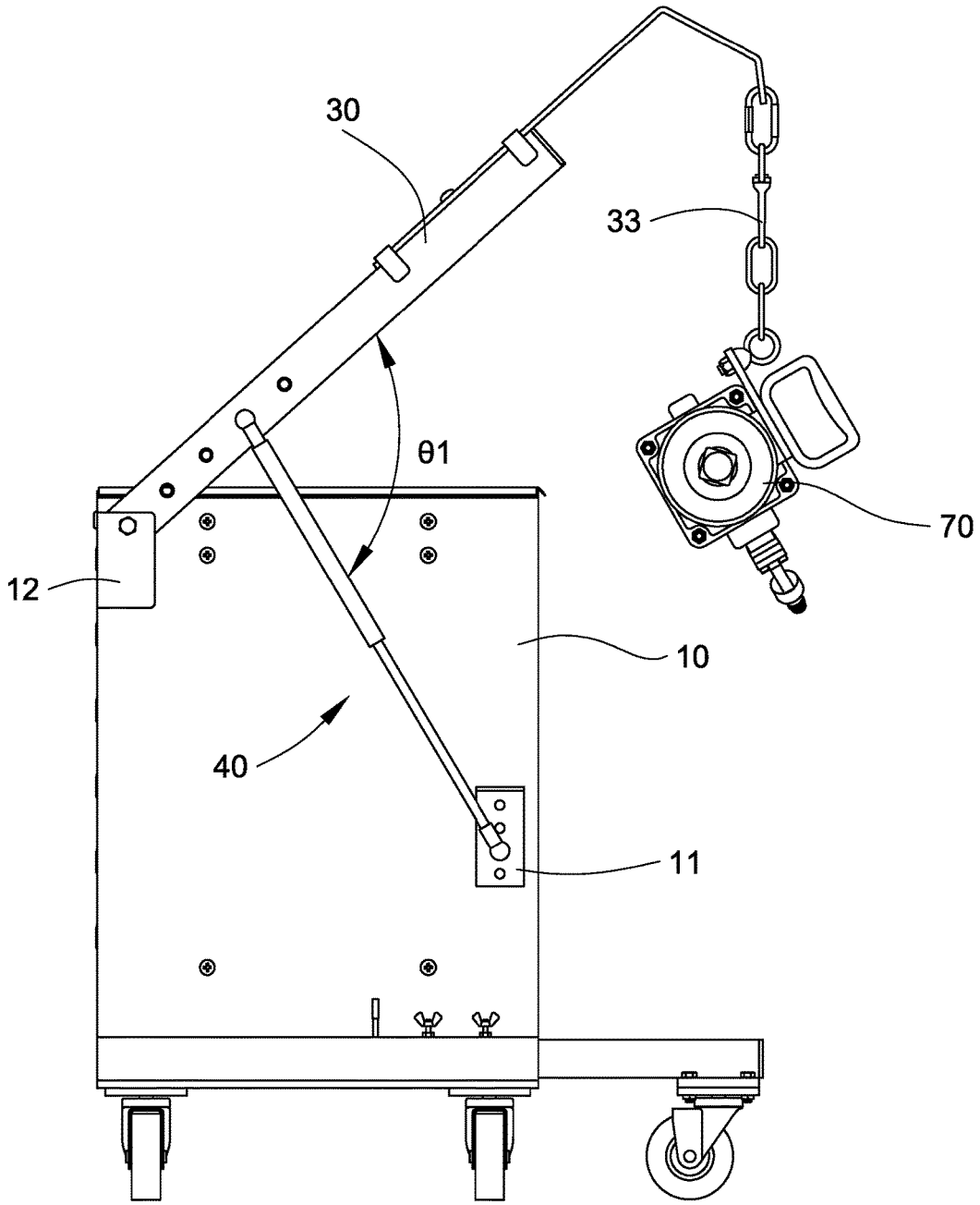
FIG. 7 is a side elevation of FIG. 6.
Figure 8:
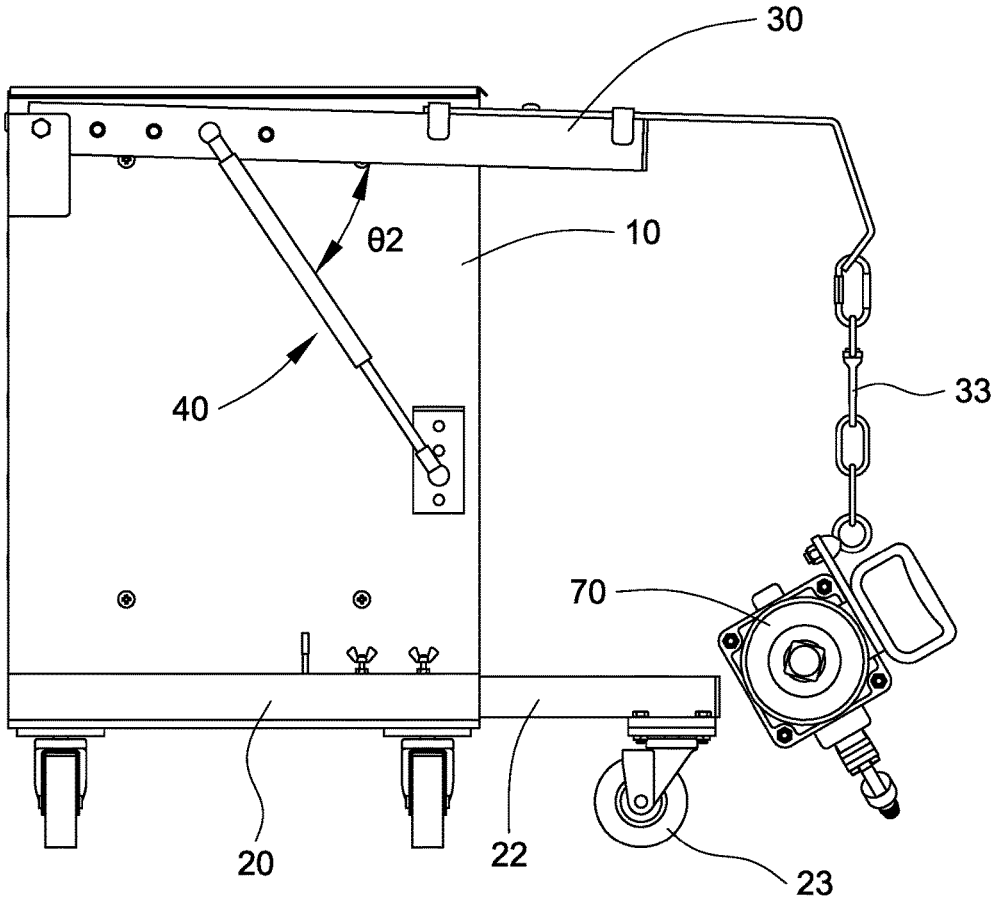
FIG. 8 is a view similar to FIG. 7 with the boom disposed horizontally.

The boom 30 is a hollow parallelepiped and includes an extension 32 extending from a front end and having a plurality of threaded holes 321, a chain 33 provided at an end of the extension 32 and configured to fasten and load a mechanical device 70 for repairing automobiles in a garage, two guard members 302 provided on an surface of a front portion of the boom 30 for allowing the extension 32 to frictionally pass through gaps between the guard members 302 and the boom 30, a threaded fastener 304 driven through one of the threaded holes 321 into a threaded hole 303 on the surface of the front portion of the boom 30 to adjustably secure the extension 32 and the boom 30 together, and a plurality of (e.g., four) threaded holes 301 provided on an outer side surface of a rear portion of the boom 30. The adjustable boom hoist 40 includes a support tube 41 and a sliding tube 42 slidably disposed in the support tube 41. The adjustable boom hoist 40 has one end releasably secured to one of the threaded holes 301 and the other end releasably secured to one of the threaded holes 111. In operation, an employee may operate the adjustable boom hoist 40 to adjust an angle of the boom 30 with respect to itself in which the angle 81 shown in FIG. 7 is maximum and the angle 82 shown in FIG. 8 is less than the angle 81.

Figure 9:
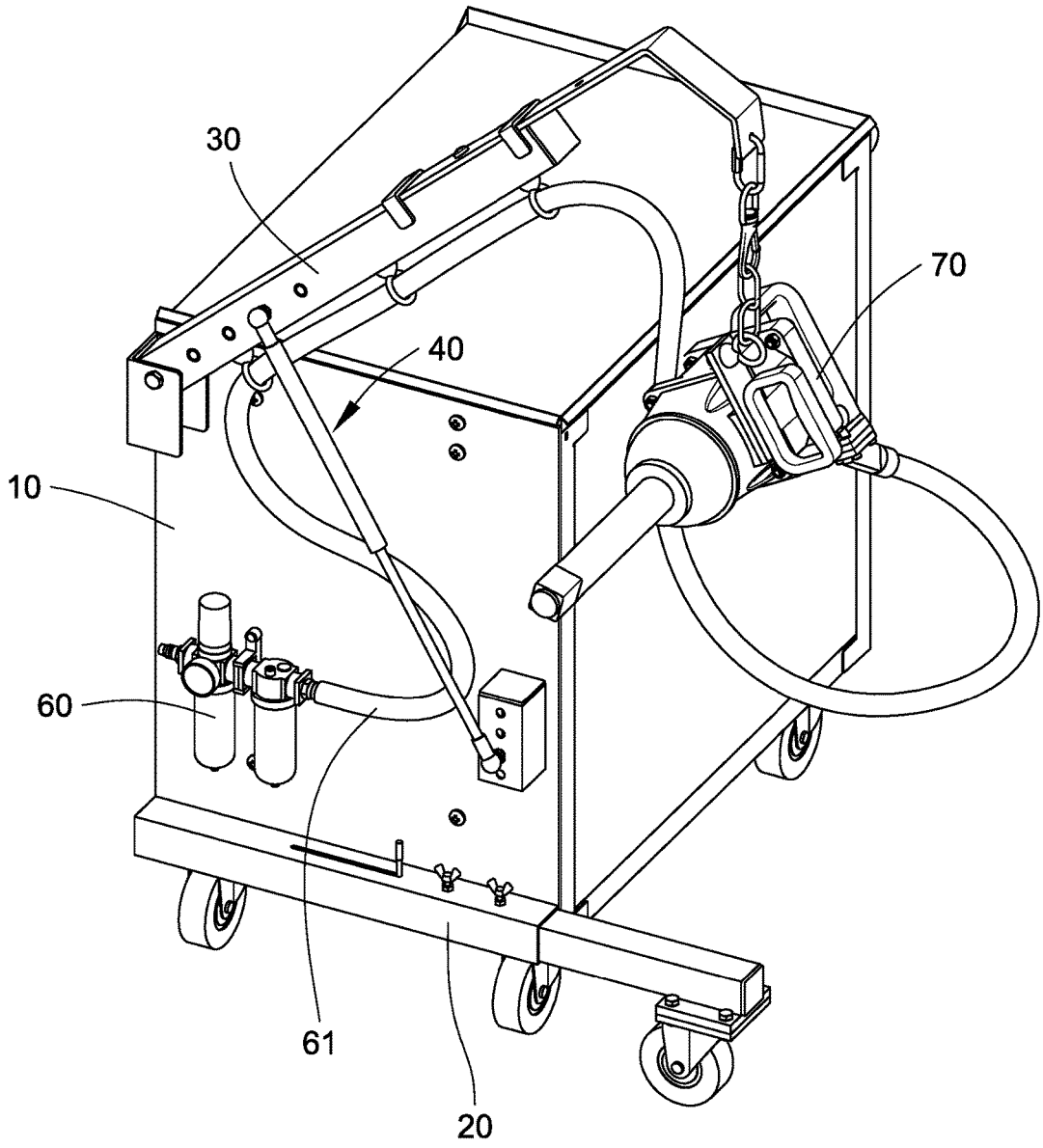
FIG. 9 is a perspective view of a cabinet having a mounted crane according to a second preferred embodiment of the invention.

Referring to FIG. 9, a wheeled cabinet according to a second preferred embodiment of the invention is shown. The characteristics of the second preferred embodiment are substantially the same as that of the first preferred embodiment except the following: an air pump 60 is mounted on the attachment board 10 and a tube 61 has one end connected to an outlet of the air pump 60 and the other end connected to the mechanical device 70.

Figure 10:
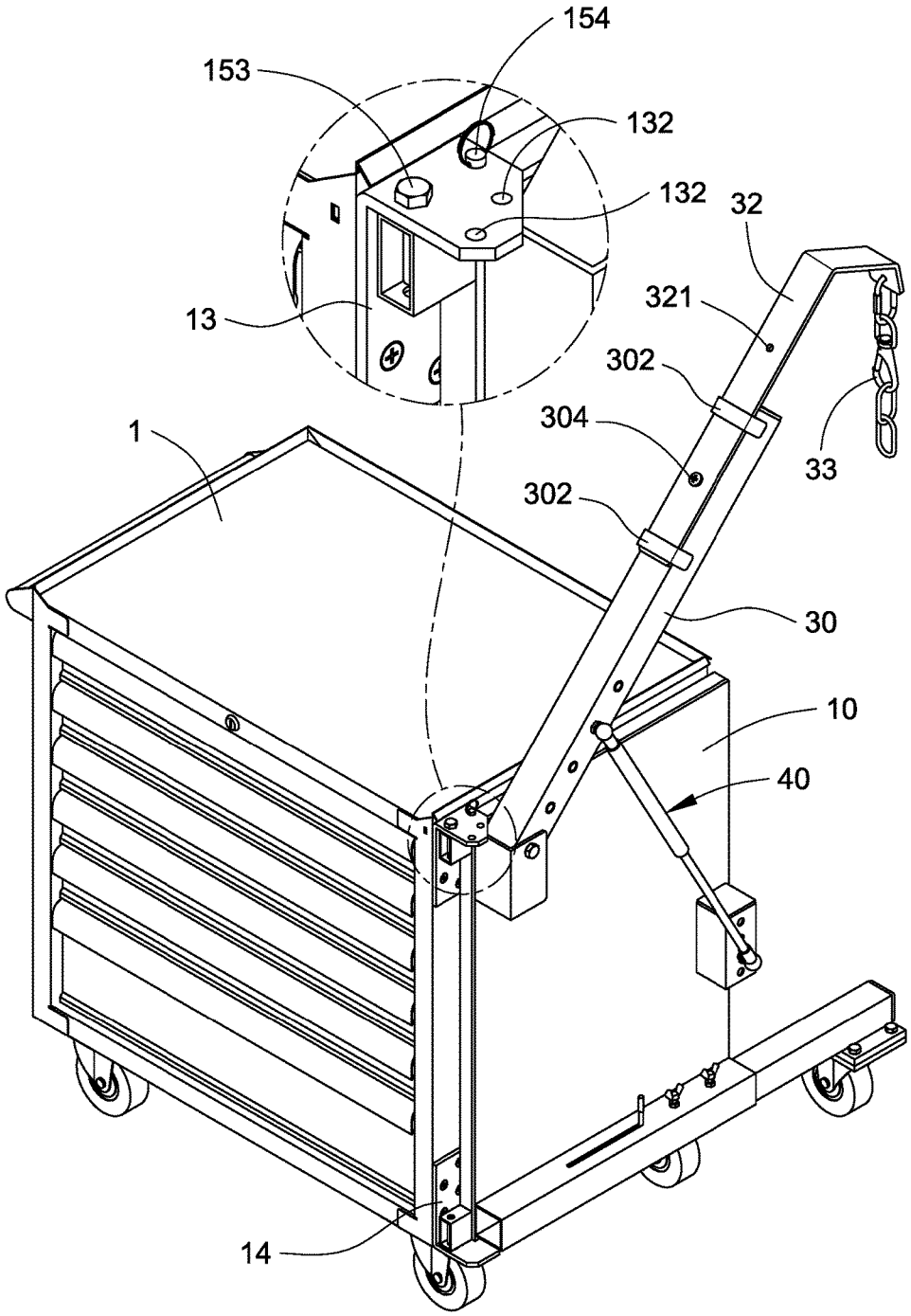
FIG. 10 is a perspective view of a cabinet having a mounted crane according to a third preferred embodiment of the invention.
Figure 11:
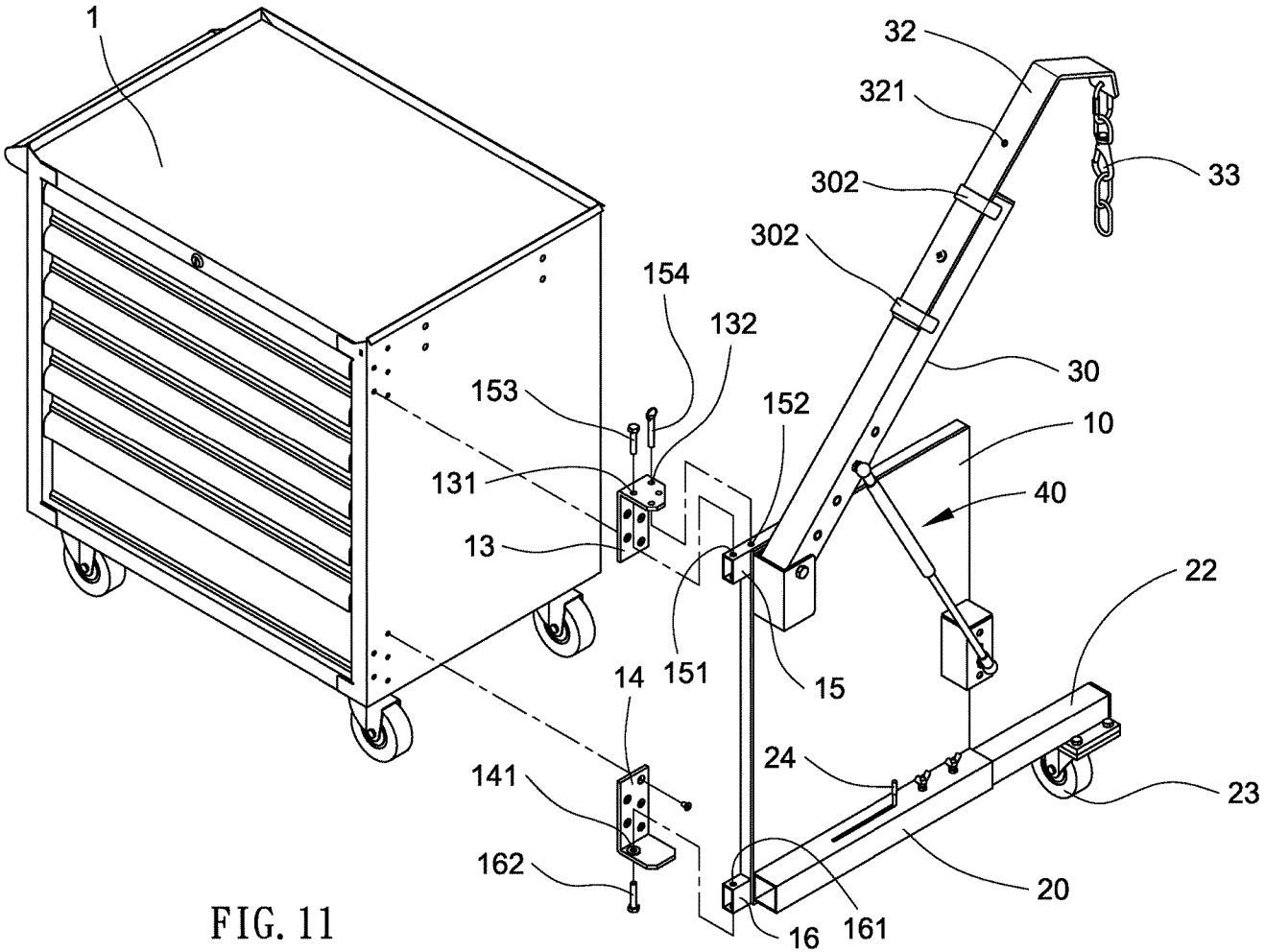
FIG. 11 is a perspective exploded view of FIG. 10.
Figure 12:
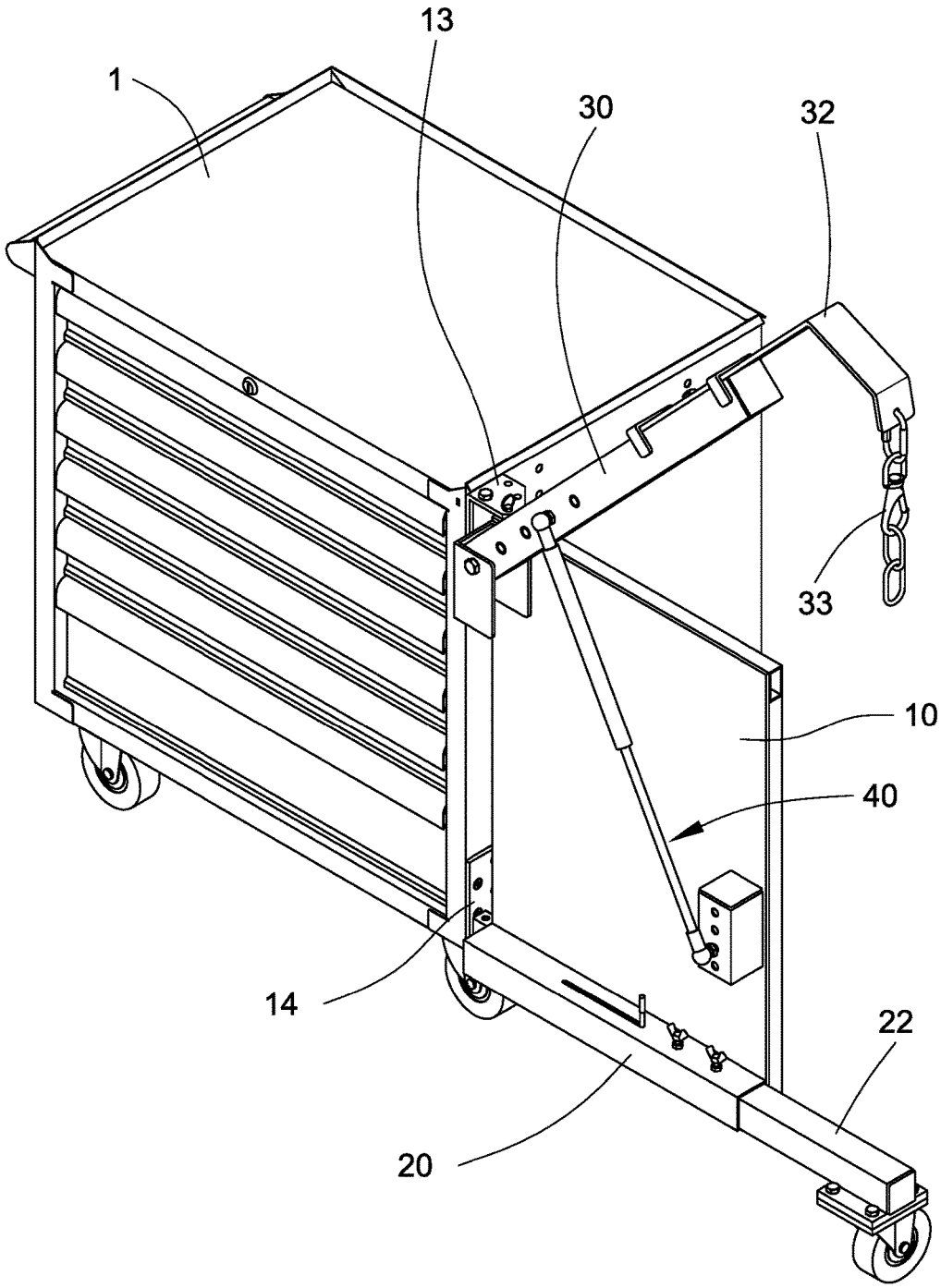
FIG. 12 is a view similar to FIG. 10 showing another configuration of the crane mounted on the cabinet.

Referring to FIGS. 10 to 12, a wheeled cabinet 1 according to a third preferred embodiment of the invention is shown. The characteristics of the third preferred embodiment are substantially the same as that of the first preferred embodiment except the following: A first tubular extension 15 is provided on a corner of the attachment board 10 adjacent to the hollow member 12 and has a first threaded hole 151 and a second threaded hole 152. A second tubular extension 16 is provided on another corner of the attachment board 10 under the first tubular extension 15 and has a third threaded hole 161. A first bent attachment 13 is threadedly secured to the cabinet 10 and has a third threaded hole 131 on top and three fourth threaded holes 132 on top, the fourth threaded holes 132 being equally spaced apart around a virtual circle. A first threaded fastener 153 is driven through the third threaded hole 131 and the first threaded hole 151 and a second threaded fastener 154 is driven through any one of the fourth threaded holes 132 and the second threaded hole 152 to fasten the attachment board 10 and the first bent attachment 13 together. A second bent attachment 14 is threadedly secured to the cabinet 1 and has a fourth threaded hole 141 on bottom. A third threaded fastener 162 is driven through the fourth threaded hole 141 and the third threaded hole 161 to fasten the attachment board 10 and the second bent attachment 14 together.

The attachment board 10 can be secured to the wheeled cabinet 1 in one configuration shown in FIG. 10 or the other configuration shown in FIG. 12. That is, a user may drive a second threaded fastener 154 through a desired one of the fourth threaded holes 132 to mount and position the attachment board 10, thereby accommodating the cabinet 1 to the working environment.

While the invention has been described in terms of preferred embodiments, those skilled in the art will recognize that the invention can be practiced with modifications within the spirit and scope of the appended claims.

What is claimed is:

1. A wheeled cabinet comprising a crane, the crane comprising:

a rectangular attachment board secured to one side of the cabinet;

a receptacle disposed on a rear end of the attachment board and including a plurality of threaded holes disposed vertically on an surface;

a hollow member disposed on a front top corner of the attachment board;

an outrigger disposed on a bottom of the attachment board and including a slot, a sliding tube slidably projecting out of a rear end, a caster mounted to a bottom of a rear end of the sliding tube, and a rod releasably secured to the sliding tube and configured to slide along the slot;

a boom having one end pivotably secured to the hollow member and including a plurality of threaded holes on a rear portion, an extension extending from the other end and threadedly secured to the boom, a chain disposed at an end of the extension, and at least one guard member disposed on a front portion of the boom for allowing the extension to frictionally pass through gaps between the at least one guard member and the boom; and an adjustable boom hoist having one end releasably secured to one of the threaded holes of the boom and the other end releasably secured to one of the threaded holes of the receptacle, the adjustable boom hoist including a support tube and a sliding tube member slidably disposed in the support tube.

2. The wheeled cabinet of claim 1, wherein the number of the threaded holes of the boom is four and the number of the threaded holes of the receptacle is four.

3. The wheeled cabinet of claim 1, wherein the number of the at least one guard member is two.

4. The wheeled cabinet of claim 1, further comprising an air pump mounted on the attachment board and a tube having one end connected to the air pump.

5. A wheeled cabinet comprising a crane, the crane comprising:

a rectangular attachment board secured to one side of the cabinet;

a receptacle disposed on a rear end of the attachment board and including a plurality of threaded holes disposed vertically on an surface;

a hollow member disposed on a front top corner of the attachment board;

an outrigger disposed on a bottom of the attachment board and including a slot, a sliding tube slidably projecting out of a rear end, a caster mounted to a bottom of a rear end of the sliding tube, and a rod releasably secured to the sliding tube and configured to slide along the slot;

a boom having one end pivotably secured to the hollow member and including a plurality of threaded holes on a rear portion, an extension extending from the other end and threadedly secured to the boom, a chain disposed at an end of the extension, and at least one guard member disposed on a front portion of the boom for allowing the extension to frictionally pass through gaps between the at least one guard member and the boom;

an adjustable boom hoist having one end releasably secured to one of the threaded holes of the boom and the other end releasably secured to one of the threaded holes of the receptacle, the adjustable boom hoist including a support tube and a sliding tube member slidably disposed in the support tube;

a first tubular extension disposed on a first corner of the attachment board adjacent to the hollow member and having a first threaded hole and a second threaded hole;

a second tubular extension disposed on a second corner of the attachment board under the first tubular extension, the second tubular extension having a third threaded hole;

a first bent attachment threadedly secured to the cabinet and having a third threaded hole on a top and a plurality of fourth threaded holes on a top;

a first threaded fastener driven through the third threaded hole and the first threaded hole and a second threaded fastener driven through the fourth threaded hole and the second threaded hole to fasten the attachment board and the first bent attachment together;

a second bent attachment threadedly secured to the cabinet and having a fourth threaded hole on a bottom; and a third threaded fastener driven through the fourth threaded hole and the third threaded hole to fasten the attachment board and the second bent attachment together.

6. The wheeled cabinet of claim 5, wherein the number of the threaded holes of the boom is four and the number of the threaded holes of the receptacle is four.

7. The wheeled cabinet of claim 5, wherein the number of the at least one guard member is two.

8. The wheeled cabinet of claim 5, wherein the fourth threaded holes are equally spaced apart around a virtual circle.

9. The wheeled cabinet of claim 5, wherein the second threaded fastener is adapted to drive through one of the fourth threaded holes to mount and position the attachment board, thereby accommodating the wheeled cabinet to the working environment.

* * * * *